United States Patent [19]

Skinner

[11] Patent Number: 4,840,374

[45] Date of Patent: Jun. 20, 1989

[54] GAME UTILIZING THE SENSE OF TOUCH

[76] Inventor: Robert M. Skinner, 15300 S. Irving, Dolton, Ill. 60419

[21] Appl. No.: 69,280

[22] Filed: Jul. 2, 1987

[51] Int. Cl.[4] ..... A63F 9/06

[52] U.S. Cl. ..... 273/1 G; 434/259

[58] Field of Search ..... 273/19 L; 434/259

[56] References Cited

U.S. PATENT DOCUMENTS

| | | | |
|---|---|---|---|
| D. 231,738 | 6/1974 | Brass | 434/259 X |
| 741,903 | 10/1903 | Gates | 434/259 |
| 947,124 | 1/1910 | Renner | 273/1 L |
| 2,747,297 | 5/1956 | Zalkind | 434/259 |
| 3,280,499 | 10/1966 | Studen | 434/259 X |
| 3,484,105 | 12/1969 | Winston | 273/1 G |
| 4,008,526 | 2/1977 | Swett et al. | 434/259 |

FOREIGN PATENT DOCUMENTS

| | | | |
|---|---|---|---|
| 370080 | 4/1932 | United Kingdom | 434/259 |

*Primary Examiner*—Paul E. Shapiro

*Attorney, Agent, or Firm*—Tilton, Fallon, Lungmus & Chestnut

[57] ABSTRACT

A game or training device for developing manual dexterity of the sense of touch of individuals, particularly sightless individuals which comprises a hollow container having two open opposed ends with a partition interposed, said partition having apertures matching the shape of blocks which the user touches and manipulates through the apertures without the use of eyesight.

7 Claims, 1 Drawing Sheet

GAME UTILIZING THE SENSE OF TOUCH

BACKGROUND OF THE INVENTION

This invention relates to a game or training device which, more particularly, may be used as a toy, or a teaching or testing device.

Developing motor perceptual skills is necessary to prepare one for reading. Motor perceptual skills can be obtained by enhancing the spacial and form concepts through visual matching. Children enjoy matching shapes by placing objects into holes or apertures that fit only that particular object. This type of activity is challenging and fun.

The present invention may be utilized as a game or training device when the user examines a block, inserts it into the hollow container with his hand and then determines by touch the specific aperture through which the block may pass.

The present invention can also be utilized by sightless individuals for developing their sense of touch. The blocks may be inserted into one section of the container wherein the sightless individual would grasp one block, determine its shape by touch and then locate the appropriate aperture in the partition leading to the second part or section of the container. The aperture may be located by the user's hand grasping the block or his other hand placed in the opposed end of the container. This type of activity for a blind individual acutely increases his sense of touch and motor skills necessary for living in a sightless world.

There is a definite need for this type of game or training device for sightless individuals.

SUMMARY OF THE INVENTION

Accordingly, the game or training device comprising a hollow container having two sections with open ends and with an aperture plate having a plurality of apertures of different sizes interposed between said two parts, the two parts being separable for removal of the aperture plate with suitable means for holding said parts together in an assembled relation. a plurality of solid forms shaped to fit respective apertures in the aperture plate are included.

It is therefore an object of the present invention to provide a manual dexterity training device that promotes enjoyment and dexterity improvement for individuals.

It is another object of the present invention to provide a game or training device to develop motor perceptual skills for those learning to read.

And yet another object of the present invention is to provide means for sightless individuals to improve their sense of touch.

DESCRIPTION OF THE DRAWINGS

With the above and other objects and advantages in view which will become more apparent as the description proceeds, this invention comprises the novel configuration, combination, and arrangement of parts, as hereinafter more fully described and as generally pointed out in the appended claims, reference being had to the accompanying drawing wherein like number is referred to like parts in several views and in which:

DESCRIPTION OF THE INVENTION

Figure 2:
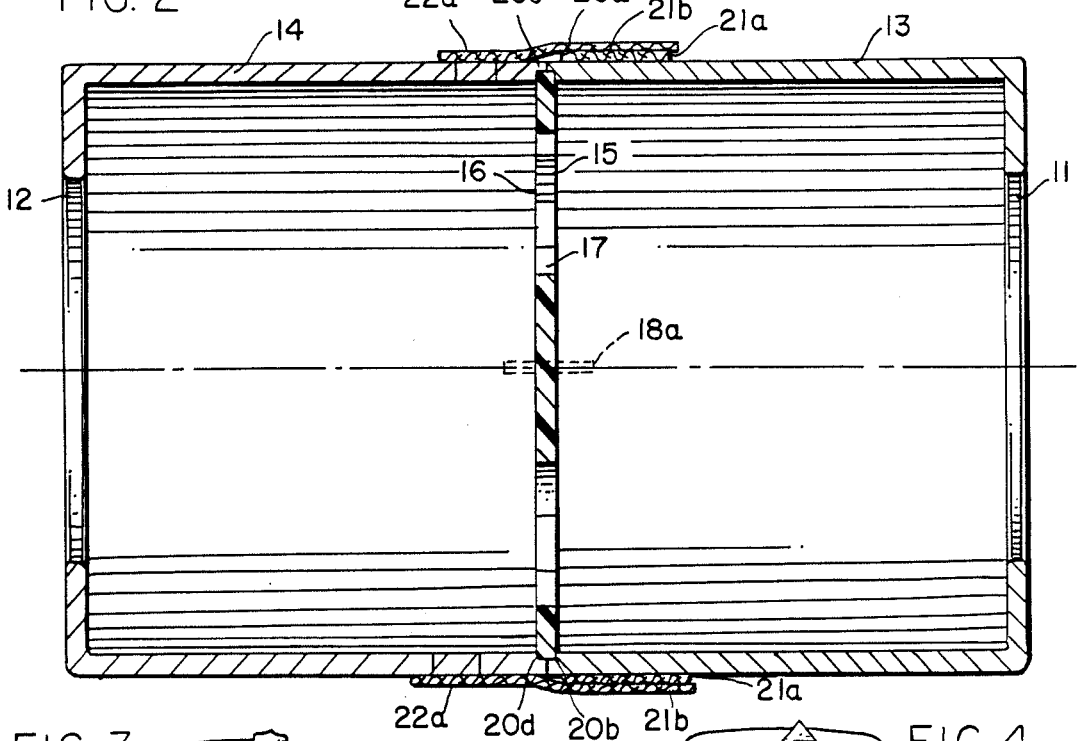
FIG. 2 is a sectional view of the present invention taken at lines 2—2 of FIG. 1.

Referring now to the drawing, the game or testing device of the present invention is illustrated including a hollow container 10 having apertures 11 and 12 formed at opposed ends of the container. The container comprises sections or parts 13 and 14 which further have apertures 15 and 16 which engage aperture plate 17 as shown in FIG. 2. Aperture plate 17 securely fits within shoulder **20*a* and 20*b* of part 13 and 20*c* and 20*d* of part 14**.

Figure 1:
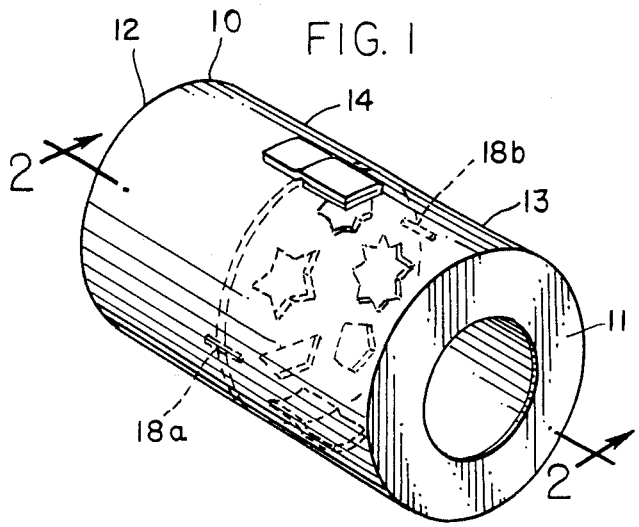
FIG. 1 is a perspective broken view of the game or training device of the present invention including a hollow container having two parts with an aperture plate interposed therebetween.
Figure 5:
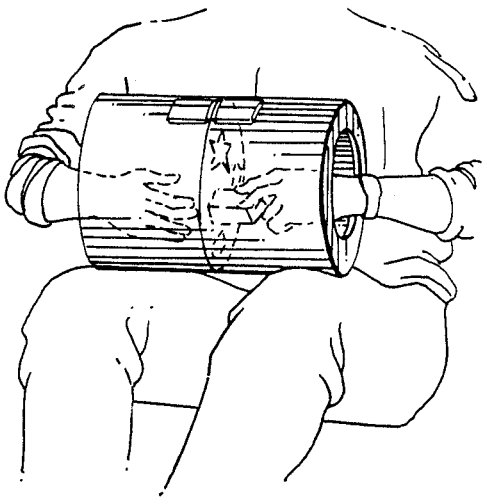
FIG. 5 is a perspective broken view showing a user inserting a block into the aperture plate interposed between said sections of the present invention.
Figure 3:
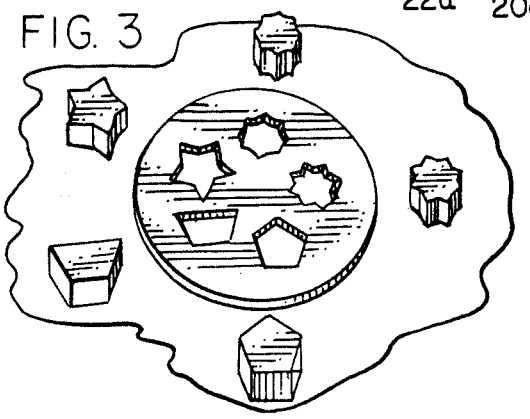
FIG. 3 is a perspective view showing an aperture plate and blocks utilized in the present invention.
Figure 4:
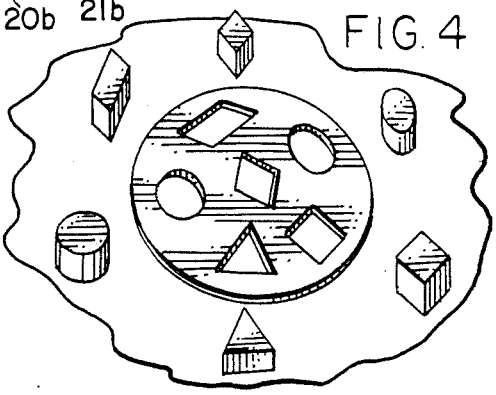
FIG. 4 is a perspective view of another aperture plate and blocks utilized in the present invention.

As indicated in FIGS. 1 and 2, aperture plate 17 is securely interposed between sections 14 and 13 by placement pins **18*a* and 18*b*. Placement pins a and b are imbedded in section 14 and engage section 13 by a fitting relationship into small openings in section 13 (not shown). To aid in the joining of sections 13 and 14 there are fastening means provided on the external surface of parts or sections 13 and 14. The fastening means may be any suitable device for joining parts 13 and 14. Preferably, interlocking tape may be utilized, such as that manufactured by Velcro Company. For example, FIG. 2 shows tape base or portion 21*a* secured on section 13 adjacent aperture 15 for receivably engaging overwrapped tape portion 21*b* which is secured at portion 22*a* in a manner which aligns interlocking tape 21*b* to engage base portion 21*a* to secure section 14 to section 13. Sections 13 and 14 can be easily separated for allowing the changing of aperture plate 17. FIGS. 3 and 4** show different aperture plates having openings that match the shape of blocks to be used with said respective aperture plate.

In operation, the user may choose an appropriate aperture plate and blocks which shapes match the openings in the aperture plate. Sections 13 and 14 of the hollow container may be separated by releasing interlocking tape **21*b* from base portion 21*a*. When parts or sections 13 and 14 are separated, an aperture plate 17 may be inserted onto shoulder 20*a*, 20*b*, 20*c*, 20*d* of said parts or sections. Further, interlocking pins 18*a* and 18*b*, position on part or section 14 are inserted into openings in part or section 13. Interlocking pins 18*a* and 18*b* do not pass through aperture plate 17. Aperture plate 17 is securely held by shoulders 20*a* through 20*d* and may be rotably mounted therein. Once aperture plate 17 is secured, the user may then commence the game or training exercise. In one instance, an individual may visually examine a block and insert it by hand into one of the apertures 11 or 12 of hollow container 10. The user's other hand is inserted into the opposed side of the container. The user's hand holding the block is moved to find the proper opening in aperture plate 17** for fitting the block therethrough. Simultaneously, the user's empty hand may be used to locate said opening. This type of activity many help young children develop motor perceptual skills or to develop manual dexterity. Further, physically disabled individuals may utilize the game or training device in a similar manner. The game or training device may also be utilized by sightless individuals where the blocks can be inserted in one section wherein the user would, by the sense of touch, locate one block and the appropriate opening utilizing the hand holding the block as well as the free hand inserting in the opposed side of the container for aligning the block through the appropriate opening. This type of activity enhances the sightless individual's sense of touch and coordination.

For the foregoing, the construction and operation of the game or training device will be readily understood and further explanation is believed to be unnecessary. However, since numerous modification and changes will readily occur to those skilled in the art, it is not desired to limit the invention to the exact construction shown and described, and accordingly, all suitable modifications and equivalents may be resorted to, falling within the scope of the appended claims.

What is claimed is:

1. A game or training device comprising a hollow container having two sections with open ends and with an aperture plate having a plurality of apertures of different sizes interposed between said two sections, the two sections being separable for removal of the aperture plate with suitable means for holding said sections together in an assembled relation.

2. The game or training device described in claim 1 having a plurality of solid forms shaped to fit respective apertures in said aperture plate.

3. The game or training device described in claim 1 which is operable entirely by touch.

4. The game or training device described in claim 1 wherein the hollow container is tubular shaped.

5. The game or training device described in claim 1 wherein the hollow container is a cylindrical section.

6. The game or training device described in claim 1 having a cross-section sufficiently large to permit user's hands to fit therein.

7. The game or training device described in claim 1 wherein the aperture plate is securely interposed between said two sections by fitting within a shoulder defined in the ends of the two sections that meet to form a hollow container.

* * * * *